United States Patent [19]

Nykopp

[11] 3,970,514

[45] July 20, 1976

[54] COMBINATION-PAPER MACHINE

[75] Inventor: Erik Albert Nykopp, Tampere, Finland

[73] Assignee: Oy Tampella AB, Tampere, Finland

[22] Filed: Feb. 4, 1975

[21] Appl. No.: 547,021

[30] Foreign Application Priority Data

Feb. 15, 1974 Finland ..... 447/74

[52] U.S. Cl. ..... 162/303; 162/318; 162/336

[51] Int. Cl.[2] ..... D21F 1/00

[58] Field of Search ..... 162/318, 336, 369, 370, 162/301, 302, 303, 132, 203, 211, 212

[56] References Cited

UNITED STATES PATENTS

| | | | |
|---|---|---|---|
| 1,739,038 | 12/1929 | Millspaugh | 162/370 |
| 3,839,143 | 10/1974 | Suckow | 162/301 |

*Primary Examiner*—Robert L. Lindsay, Jr.
*Assistant Examiner*—George C. Yeung
*Attorney, Agent, or Firm*—Roylance, Abrams, Berdo & Kaul

[57] ABSTRACT

A combination-paper machine, especially one for the continuous manufacture of thick paper, cardboard or the like, is disclosed as having two perforated cylinders which form a combining space or slit between them, devices for feeding pulp suspension onto the perforated cylinders prior to the combining point, whereby an endless wire is guided along at least that surface of each perforated cylinders which is between the pulp suspension feeding point and the combining point, the pulp suspension feeding devices including two roof-like upper lips which cover at least part of the wire-covered surface of each perforated cylinder prior to the combining point. The roof-like upper lips are mutually separate and independent, the combining space is slightly greater than the thickness of the completed web, and after the combining point both the wires are guided to run over a certain distance along the surface of one and the same perforated cylinder.

4 Claims, 5 Drawing Figures

COMBINATION-PAPER MACHINE

BACKGROUND OF THE INVENTION

The invention relates to a combination-paper machine, especially to one adapted for the continuous manufacture of thick paper, cardboard or the like, having two perforated cylinders with a web-combining point between them, and devices for feeding the pulp suspension onto the perforated cylinders prior to the combining point, whereby an endless wire is guided along at least that surface of each perforated cylinder which is between the pulp suspension feeding point and the combining point.

Previously known is a combination-paper machine for the continuous manufacture of thick paper in layers, having several successive cylinder units at a certain interval from each other, below which there is fitted an endless lower wire or felt common to all the units to receive and combine the paper webs. The cylinder units also share a common felt or wire which runs over part of their surface and which has been fitted to run alternately against the surface of each cylinder unit from the first to the last, and from there back to the first cylinder unit with the purpose of transferring the pulp web formed on each cylinder to the lower wire in order to combine the webs.

With this previously known combination-paper machine, the water can be extracted from each layer separately and on both sides. Thereby the wet limit of each layer is reached even before the layers are combined, which results in the disadvantage that the adhesion of the layers to each other may be poor.

In addition, through U.S. Pat. No. 2,911,039 a paper machine is known which has two perforated cylinders which have been fitted one on top of the other so that a pressing point is formed between them. Two wires are guided through this point and each of them has been fitted to run along part of the surface of its own cylinder prior to the pressing point. On this surface part, pulp suspension is fed onto each wire separately from two feeding boxes operated by pressure, each feeding box having a curved lip extending over the said part of the cylinder and the feeding boxes together with the cylinders and the pressing point forming a closed space which is under pressure. The pressing space is approximately equal to the thickness of the completed web, so that substantially all the water is extracted before the pressing point. Thus the water is extracted from each layer on one side through the cylinder surface part under the curved lip.

Even this apparatus has a disadvantage in that the wet limit is reached before the layers meet since almost all the water is extracted before the pressing point. Between the meeting point of the feeding-box upper lips and the pressing point the layers are, it is true, in contact with each other over a very short distance, but in this area the webs no longer contain very much water as it is necessary to extract the water from each layer separately long before the pressing point in the space between the curved lip and the cylinder. Even this distance would be too short if pressure were not used as an aid to make the extraction of water more effective.

Some of the disadvantages of this apparatus are thus the extraction of water on one side only, the fact that the layers are combined substantially only after their reaching the wet limit, at which time the layers adhere poorly to each other, the fact that the extraction of water is carried out over too short a distance, which may result in an uneven distribution of the fibers in the web, and that sealing between the pressure feeding boxes and the perforated cylinders is difficult when the feeding boxes are under high pressure.

The object of the present invention is to eliminate the above disadvantages.

SUMMARY OF THE INVENTION

According to the invention there is provided a novel and useful combination-paper machine wherein the roof-like upper lips of a pulp feeding device are mutually separate and independent, the slit between a pair of parallel, perforated cylinders having a width greater than the thickness of the finished web and wherein the wires are guided to run over one and the same cylinder even some distance after the slit.

Thus even in a combination-paper machine according to the invention feeding boxes with roof-like upper lips are used, but they do not form, with the pressing point, a space which is under pressure since the purpose is not to extract all the water prior to the pressing point but only approx. 50–75% of the water present in the layers, and this can be easily achieved even without pressure. Water extraction is thus relatively smooth and there are no sealing problems. The layers can comprise different types of pulp components and the initial formation of the layers takes place under control and independently between the roof-like upper lip and the cylinder part covered by the wire.

The slit or combining space is also greater than required by the thickness of the completed web, so that the wet limit of the layers has not yet been reached at the combining point. This makes it possible to combine the layers tightly by extracting the remainder of the water after the combining point. This is possible since both of the wires are guided to run over some distance after the combining point along the surface of one and the same perforated cylinder, whereby water extraction on both sides of the web is simultaneously achieved. The wet limit is thus reached at the point where the web is pressed between the two wires, whereby the layers will adhere to each other tightly.

With an apparatus according to the invention, paper consisting of two or more layers can be manufactured. The third and further layers are formed by feeding pulp suspension from between the feeding boxes provided with a roof-like upper lip.

DESCRIPTION OF THE PREFERRED EMBODIMENTS

Figure 1:
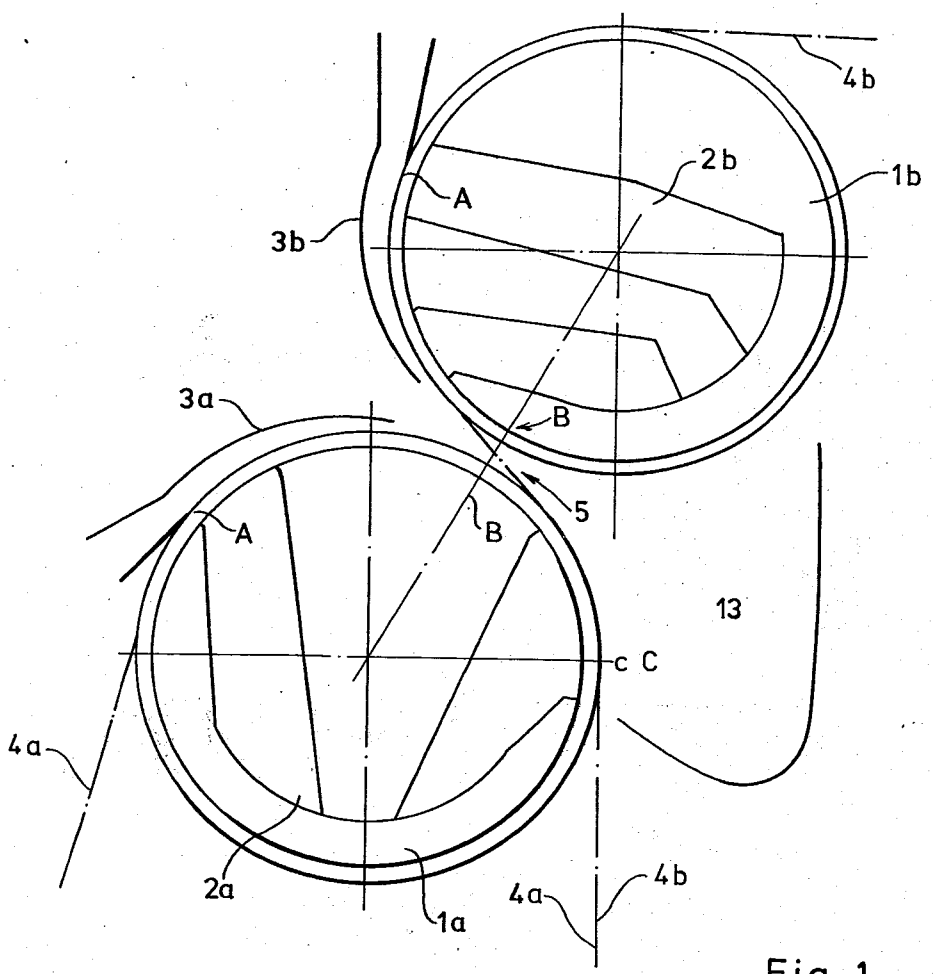
FIG. 1 shows a schematic side view, on an enlarged scale, of a detail of a combination-paper machine for forming a two-layered web.
Figure 3:
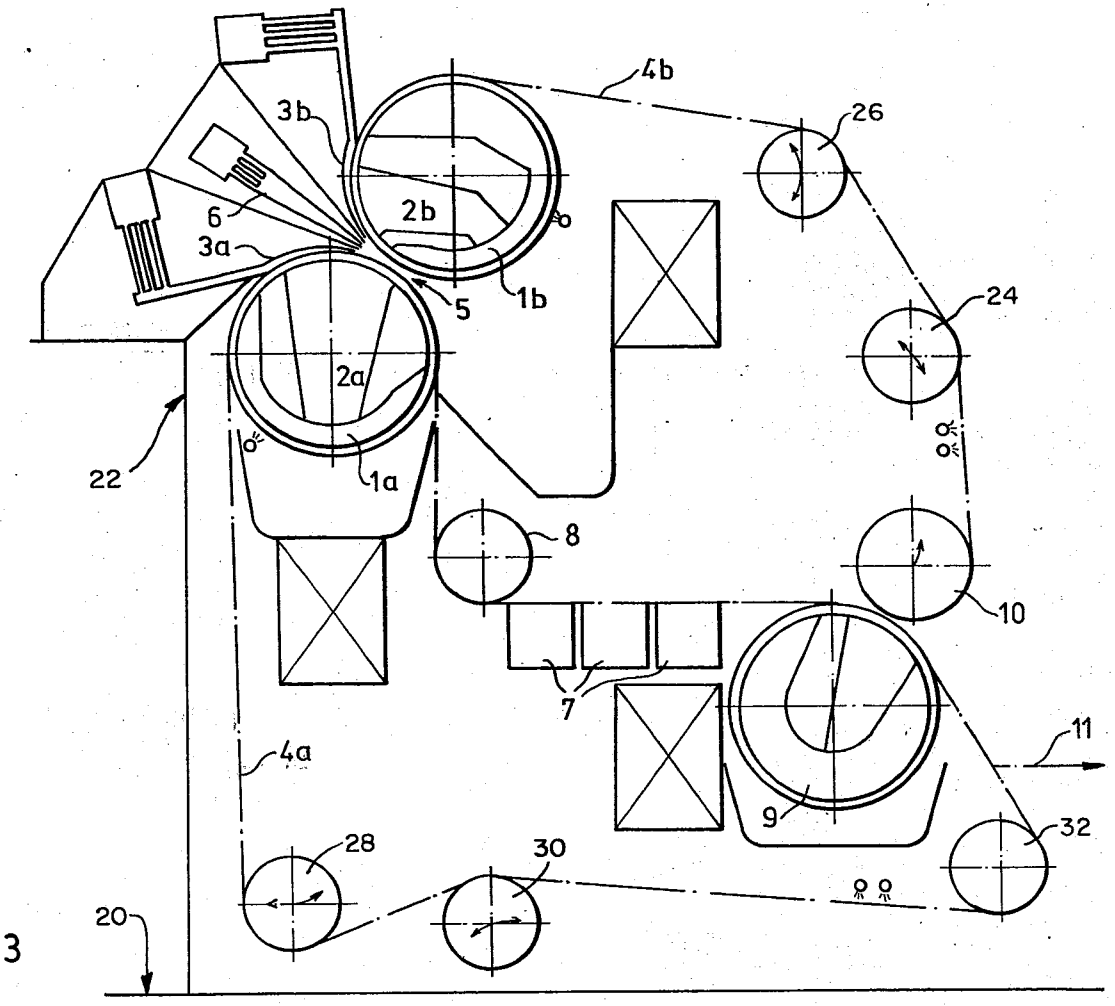
FIGS. 3–5 show schematic side views of different alternative embodiments of the combination-paper machine according to the invention.

As seen from FIG. 1, the perforated cylinders 1*a* and 1*b*, inside which there are water extraction devices for sucking water from the pulp suspension through the mantle of the perforated cylinder, have been fitted partly one on top of the other so that a combining space 5 is created between them, these perforated cylinders being rotatably supported on frame 22 as shown in FIG. 3.

An endless wire 4*a* and 4*b* has been fitted around each perforated cylinder 1*a* and 1*b*, and also around rollers 24, 26, 28, 30 and 32 as shown in FIG. 3 which rollers are attached to frame 22 and guide the endless wires, so that each wire contacts at least that part A–B of the surface of the respective perforated cylinder 1*a* or 1*b* on which the initial formation of the web takes place prior to the combining point 5. After the combining point, both wires 4*a* and 4*b* follow the surface of one and the same perforated cylinder 1*a* over a certain distance B–C, over which distance the rest of the water is extracted into the trough 13 by the pressure created by both centrifugal force and wire tautness and into the perforated cylinder 1*a* by suction apparatus 2*a*. The area of influence of the suction apparatus 2*a* extends from point A to approx. point C on the circumference of the perforated cylinder 1*a*. The area of influence of the suction apparatus 2*b*, on the other hand, extends only from point A to approx. point B on the circumference of the perforated cylinder 1*b*. The wet limit of the layers is formed somewhere along distance B–C, where the layers are pressed between the wires 4*a* and 4*b*. Both suction apparatus 2*a* and 2*b* are also attached to frame 22 as shown in FIG. 3.

The output of the web-former is substantially dependent on the effectiveness of the water extraction of the apparatus. With a web-former according to the invention it is possible to achieve a great output since the extraction of water is performed by two suction cylinders and within the wire area B–C, as explained above.

It should be noted that the distance between the perforated cylinders 1*a* and 1*b* at the pressing point 5 is slightly greater than the combined thickness of the wires 4*a* and 4*b* and of the completed web 11, so that the layers still contain some 50–25% of the original water amount when they move from area A–B to area B–C, where the extraction of water takes place on both sides, namely, inwards into the suction apparatus 2*a* of the perforated cylinder 1*a* and outwards through the wire 4*b*, owing to the centrifugal force.

Figure 2:
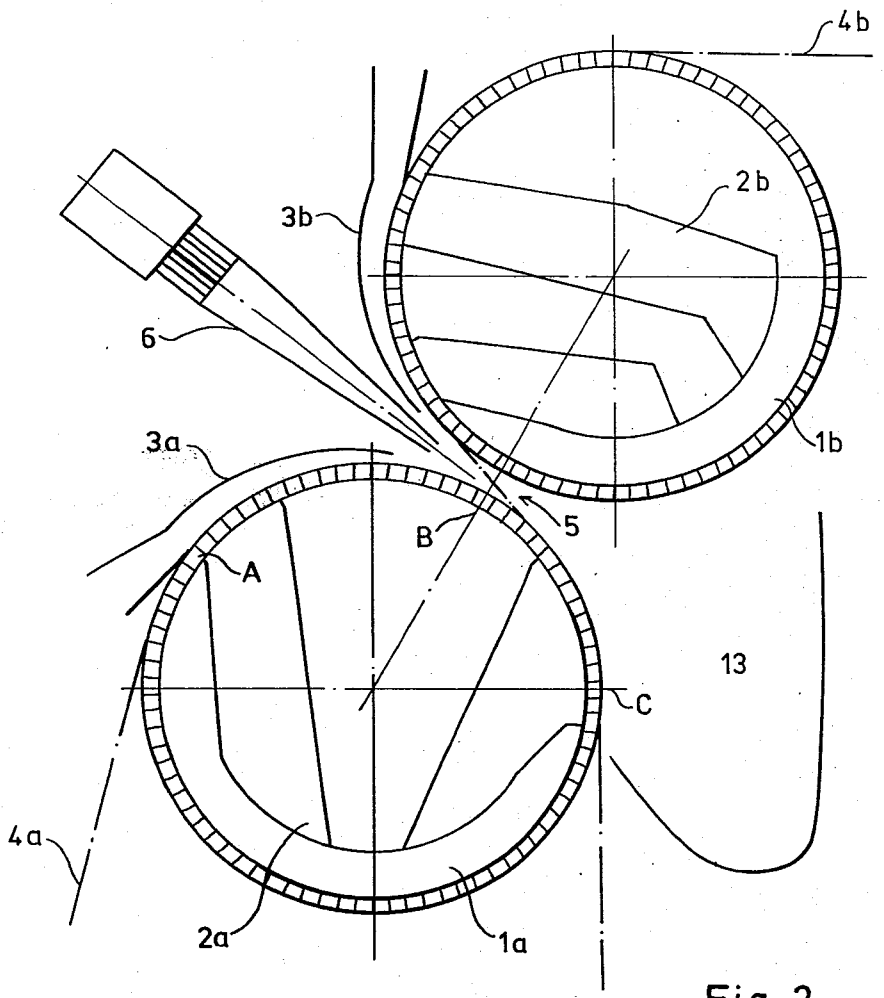
FIG. 2 shows a similar view but of a machine for the manufacture of a three-layered web.

The apparatus shown in FIG. 2 deviates from the one described above only in the respect that in this case a third feeding box 6 for feeding pulp suspension to the pressing point 5 to form an intermediate layer for the web has been fitted between the roof-like upper lips 3*a* and 3*b* of the feeding boxes, all of these feeding boxes 3*a*, 3*b* and 6 being attached to frame 22 as shown in FIG. 3.

In the embodiment shown in FIG. 3, the web-forming part shown in FIG. 2 is shown with the entire combination-paper machine including a base 20 and a frame 22 on the base, and this shows that the wires 4*a* and 4*b* and the web 11 between them are directed around the turning roller 8 and over the suction boxes 7 for the final extraction of water from the web 11, whereafter the wires are separated from each other by a suction-press roll pair 9 and 10 so that the completed web can be detached from the lower wire 4*a*.

Figure 4:
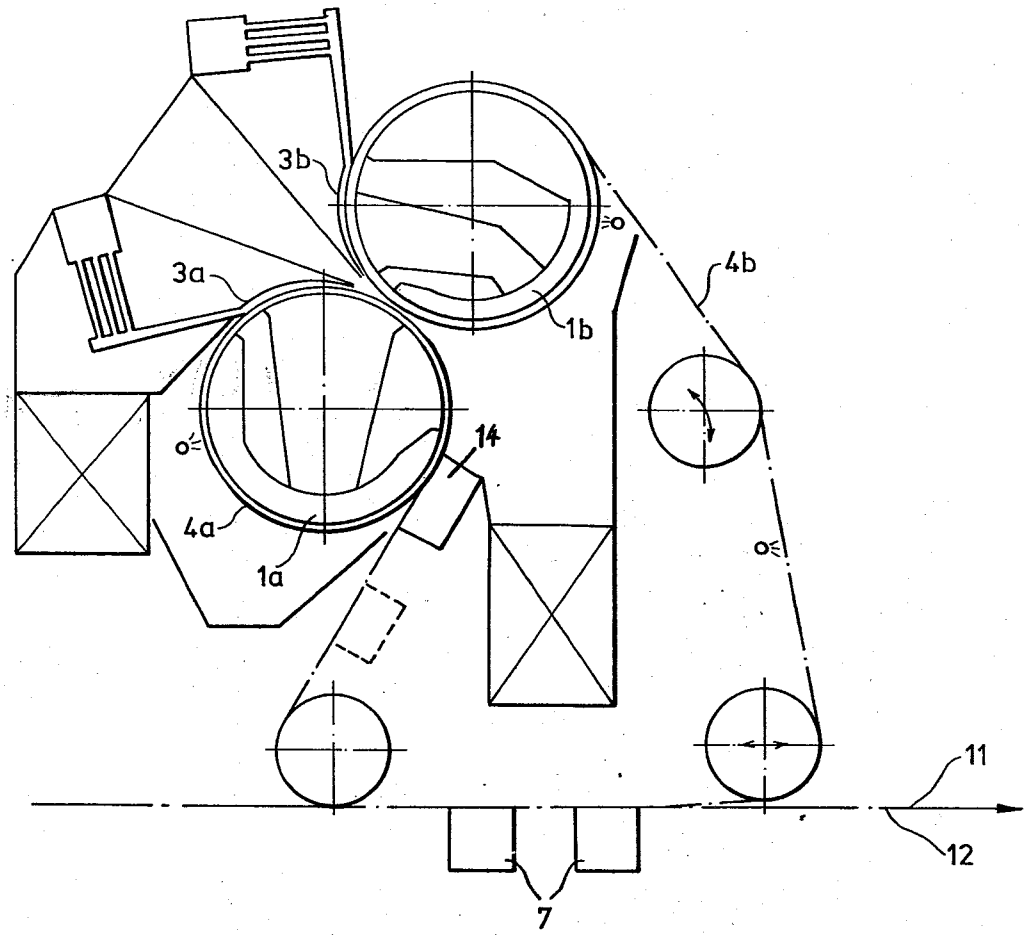

In the embodiment shown in FIG. 4, the entire circumference of the perforated cylinder 1*a* is encircled by the wire 4*a*, whereby the other wire 4*b* has been guided to follow the surface of the perforated cylinder 1*a* after the combining point. The web is caused to follow the wire 4*b* by means of a suction box 14. Thereafter the endless wire 4*b* transfers the web 11 onto the horizontal wire 12 below. Water is still extracted from the web 11 by means of suction boxes 7, when the web is between the wires 4*b* and 12. This combination-paper machine manufactures two-layered paper.

Figure 5:
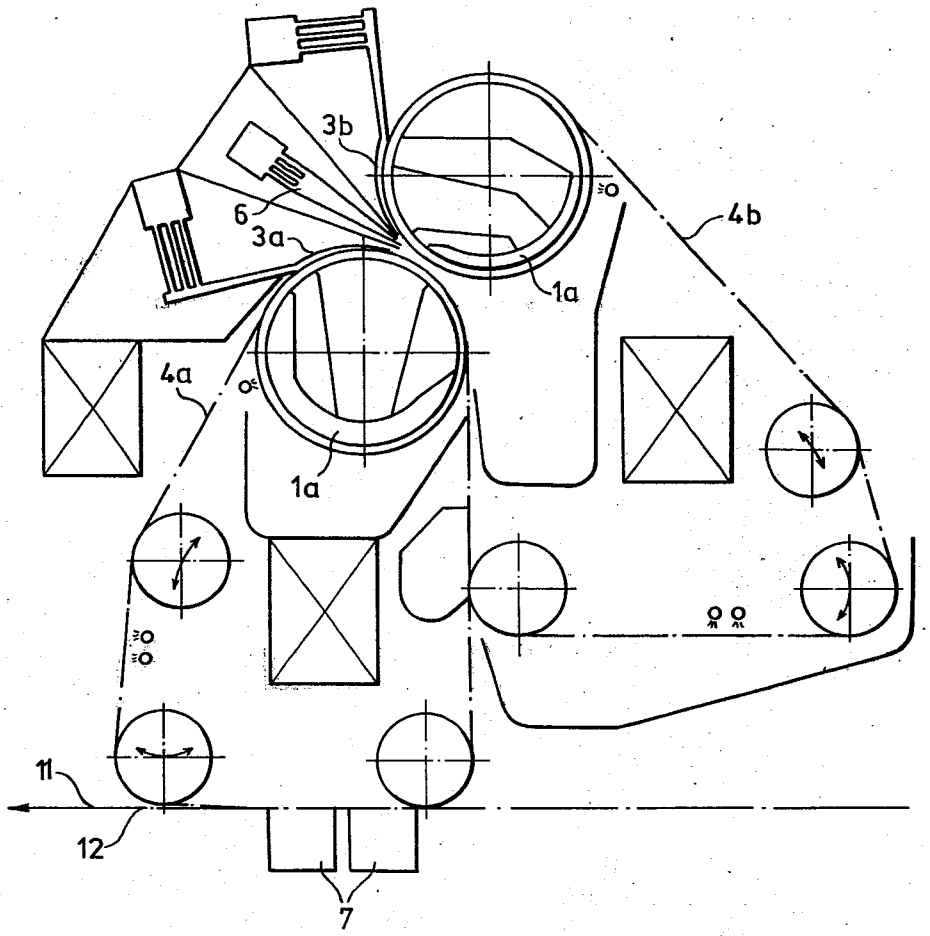

The embodiment shown in FIG. 5 deviates from the previous one only in that in this combination-paper machine there is a third feeding box 6 for the manufacture of three-layered paper and that the wire 4*a* of the perforated cylinder 1*a* extends over only part of the circumference of the perforated cylinder 1*a*, whereby the wires run downwards over a certain distance together before they are separated from each other, and the web 11 is transported by the wire 4*a* onto the horizontal wire 12.

I claim:

1. A combination-paper machine for the continuous manufacture of a fibrous web comprising:

a base;

a frame on the base;

a pair of perforated cylinders rotatably supported on the frame with parallel axes at such distance from each other that the width of a slit formed therebetween is slightly greater than the thickness of the finished web;

two endless wires each separately guided along the surface of a different one of the perforated cylinders a distance extending from a pulp suspension feeding point to at least the slit;

means attached to the frame for guiding the wires along the surface of the respective perforated cylinder from the suspension feeding point to the slit and then along the surface of only one of the cylinders from the slit to a position further along the surface of said one of the cylinders;

means attached to the frame at the pulp suspension feeding point for feeding pulp suspension onto the wire-covered surface of each perforated cylinder on which the initial formation of the web takes place and including two mutually separate and independent roof-like upper lips each covering at least part of each one of the wire-covered cylinder surfaces;

suction means, attached to the frame, for drawing water from the web while the web proceeds along the surface of said one of the cylinders from the slit to a position further along the surface of said one of the cylinders; and means for detaching the finished web from one of the wires.

2. The combination-paper machine according to claim 1, wherein the pulp suspension feeding means further include a feeding device attached to the frame and directed towards the slit and fitted between the two roof-like upper lips for forming an intermediate layer for the web.

3. The combination-paper machine according to claim 1, one of the wires has been guided around the entire circumference of one perforated cylinder, the other wire being guided a certain distance along the surface of said one perforated cylinder after the slit.

4. The combination-paper machine according to claim 1, wherein the guiding means are designed to guide the wires to run a certain distance together aftr being detached from the surface of the one perforated cylinder, at least one suction box being attached to the frame on one side of the wires running together to withdraw additional water from the web while the web is still being pressed between the wires.

* * * * *